US010407756B2

(12) United States Patent
Lee et al.

(10) Patent No.: US 10,407,756 B2
(45) Date of Patent: Sep. 10, 2019

(54) ALUMINUM ALLOY FOR CYLINDER HEAD

(71) Applicant: Hyundai Motor Company, Seoul (KR)

(72) Inventors: Kyung Moon Lee, Uiwang-si (KR); Hoo Dam Lee, Anyang-si (KR); Jong Kook Lee, Suwon-si (KR); Byung Ho Min, Seoul (KR)

(73) Assignee: Hyundai Motor Company, Seoul (KR)

( * ) Notice: Subject to any disclaimer, the term of this patent is extended or adjusted under 35 U.S.C. 154(b) by 266 days.

(21) Appl. No.: 15/499,418

(22) Filed: Apr. 27, 2017

(65) Prior Publication Data

US 2018/0135152 A1 May 17, 2018

(30) Foreign Application Priority Data

Nov. 16, 2016 (KR) ..... 10-2016-0152319

(51) Int. Cl.
*C22C 21/02* (2006.01)
*F02F 1/24* (2006.01)

(52) U.S. Cl.
CPC ..... *C22C 21/02* (2013.01); *F02F 1/24* (2013.01)

(58) Field of Classification Search
CPC ..... C22C 21/02
USPC ..... 420/528–553; 123/193.5
See application file for complete search history.

(56) References Cited

U.S. PATENT DOCUMENTS 5,545,487 A * 8/1996 Ishijima ..... C22C 1/0416 428/545

FOREIGN PATENT DOCUMENTS

| | | | |
|---|---|---|---|
| JP | 2005264301 | A | 9/2005 |
| JP | 2014152375 | A | 8/2014 |
| KR | 101646270 | B1 | 8/2016 |

* cited by examiner

*Primary Examiner* — Anthony J Zimmer
*Assistant Examiner* — Ricardo D Morales
(74) *Attorney, Agent, or Firm* — Slater Matsil, LLP

(57) ABSTRACT

Disclosed herein is an aluminum alloy for a cylinder head. The aluminum alloy according to an embodiment comprises, by weight, Si: 4.5~5.0%, Cu: 3.0~4.0%, Fe: 0.2~0.5%, Mn: 0.02% or less (exclusive of 0%), Mg: 0.1~0.3%, Zr: 0.1% or less (exclusive of 0%), Cr: 0.1~0.2%, and a balance of Al and inevitable impurities to form 100%, with a reinforcing phase of Al(Fe,Cr)Si ranging from 1.0 to 2.3%.

12 Claims, 6 Drawing Sheets

ALUMINUM ALLOY FOR CYLINDER HEAD

CROSS-REFERENCE TO RELATED APPLICATIONS

The present application claims priority to Korean Patent Application No. 10-2016-0152319, filed Nov. 16, 2016, the entire contents of which is incorporated herein for all purposes by this reference.

TECHNICAL FIELD

The present disclosure relates to an aluminum alloy for a cylinder head.

BACKGROUND

A cylinder head is a main part of an engine, providing space for the passages that feed air and fuel to the cylinder and that allow exhaust to escape. Usually, the explosion within a combustion chamber heats the bottom of a cylinder head to up to approximately 200° C. With the increase in the temperature of the combustion chamber, the fuel is likely to spontaneously ignite, inducing the occurrence of a knocking phenomenon. Engine knocking, if occurring, degrades the durability of the engine and lowers fuel efficiency.

To prevent a knocking phenomenon in the combustion chamber, the heat generated after the explosion should be rapidly released. Therefore, a cylinder head made of a material having high thermal conductivity is capable of rapidly releasing the heat transferred from the combustion chamber to the head, which leads to an increase in fuel efficiency.

Conventional cylinder heads for gasoline engines are constructed by molding an Al—Si—Cu-based alloy, AC2B, through gravity casting, and then by T7 heat treatment.

The AC2B alloy includes, by weight, Si: 5.5~6.5%, Fe: 1.0%, Cu: 3.0~4.0%, Mn: 0.6%, Mg: 0.1%, Ni: 0.35%, Zn: 1.0%, a balance of Al, and inevitable impurities to form 100%.

As for the physical properties of the AC2B alloy having this composition, the AC2B alloy, after T7 heat treatment, exhibits a yield strength of 220 MPa or higher, a tensile strength of 270 MPa or higher, an elongation rate of 1.0% or higher, and a thermal conductivity of 160 W/mK@25° C. and 165 W/mK@ 200° C.

An AC2B alloy can increase in strength and castability with a higher content of an $Al_2Cu$ strengthener and a Si precipitate. However, the formation of excessive precipitates may be a cause of reduced thermal conductivity.

A cylinder head is required to maintain high strength and thermal conductivity at high temperatures. Although having sufficient strength, conventional AC2B alloys are deficient in thermal conductivity.

There is, therefore, a need for a novel aluminum alloy that allows the cylinder head to maintain excellent thermal conductivity at the high temperature (200° C.) that occurs during the operation of the cylinder while having strength as high as or higher than conventional alloys.

SUMMARY

The present disclosure relates to an aluminum alloy for a cylinder head. In particular embodiments, the present disclosure relates to an aluminum alloy for a cylinder head, which exhibits excellent thermal conductivity and tensile strength at high temperatures that occur during the operation of the cylinder.

An aspect of the present disclosure provides an aluminum alloy for use in a cylinder head of an automotive engine, comprising, by weight, Si: 4.5~5.0%, Cu: 3.0~4.0%, Fe: 0.2~0.5%, Mn: 0.02% or less (exclusive of 0%), Mg: 0.1~0.3%, Zr: 0.1% or less (exclusive of 0%), Cr: 0.1~0.2%, and a balance of Al and inevitable impurities to form 100%, with a reinforcing phase of Al(Fe,Cr)Si ranging from 1.0 to 2.3%.

In an embodiment, the aluminum alloy has a thermal conductivity of 185 W/mK or higher at 200° C.

In another embodiment, the aluminum alloy has a tensile strength of 290 MPa or higher.

In another embodiment, the aluminum alloy has a weight ratio of Fe/Cr ranging from 1.0 to 2.5.

In another embodiment, the reinforcing phase of Al(Fe, Cr)Si is polygonal.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF ILLUSTRATIVE EMBODIMENTS

Figure 1:
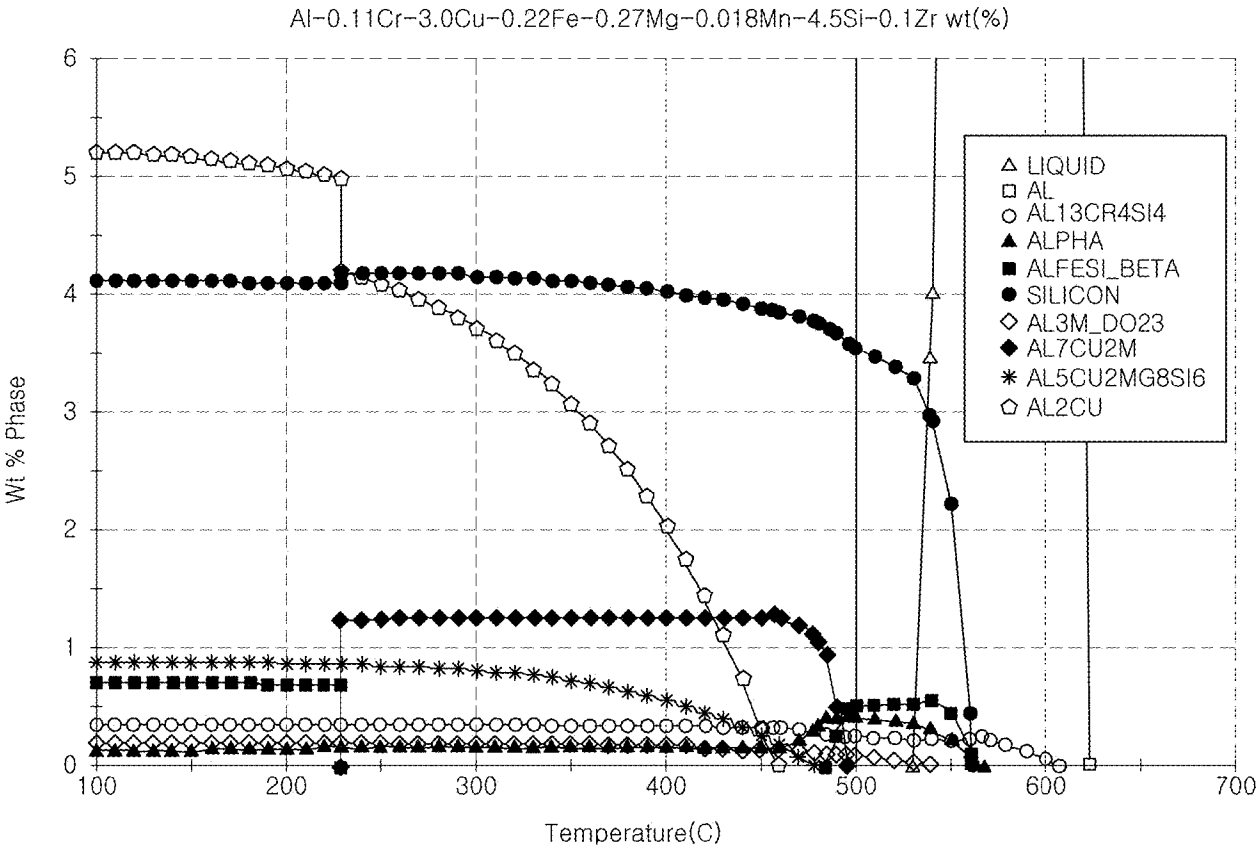
FIGS. 1 to 3 depict qualitative and quantitative analysis results of reinforcing phases formed by temperature in aluminum alloys according to embodiments of the present disclosure.

For illustrative purposes, the principles of the present disclosure are described with reference to various exemplary embodiments. Although certain embodiments of the disclosure are specifically described herein, one of ordinary skill in the art will readily recognize that the same principles are equally applicable to, and can be employed in, other systems and methods. Before explaining the disclosed embodiments of the present disclosure in detail, it is to be understood that the disclosure is not limited in its application to the details of any particular embodiment shown.

With reference to the accompanying drawings, a description will be given of a cylinder alloy for use in a cylinder head in accordance with some embodiments of the present disclosure.

The aluminum alloy for a cylinder header includes, by weight, Si: 4.5~5.0%, Cu: 3.0~4.0%, Fe: 0.2~0.5%, Mn: 0.02% or less (exclusive of 0%), Mg: 0.1~0.3%, Zr: 0.1% or less (exclusive of 0%), Cr: 0.1~0.2%, and a balance of Al and inevitable impurities to form 100%. Particularly, the aluminum alloy has a weight ratio of Fe/Cr ranging from 1.0 to 2.5.

In accordance with a particular embodiment of the present disclosure, the aluminum alloy contains an Al(Fe,Cr)Si phase dispersed in an amount of 1.0~2.3% as a reinforcing phase.

Below, the reasons for the numerical limitations of the components in the composition according to the present disclosure will be described. Unless described otherwise, the unit % given in the following description means % by weight.

Si: 4.5~5.0%: Silicon (Si), an element serving to enhancing castability, is required to be added in an amount of 4.5% or greater in order to secure castability and strength. At an amount of Si greater than 5.0%, the thermal conductivity of the alloy at high temperatures cannot be increased to the desired level. Hence, the content of Si is limited to a maximum of 5%.

Cu: 3.0~4.0%: Copper (Cu) plays a role in forming an $Al_2Cu$ precipitate phase and an AlCuFe precipitate to thus increase the strength of the aluminum alloy. For this, Cu is added in an amount of 3.0% or higher. More than 3.0% Cu, however, results in a decrease in thermal conductivity despite an increase in strength.

Fe: 0.2~0.5%: Iron (Fe) is effective for enhancing the strength of the aluminum alloy through the formation of an AlFeSi phase and for preventing die soldering. In combination with Cr, Fe forms a polygonal precipitate that contributes to thermal conductivity and elongation rate. For this, Fe is added in an amount of 0.2% or higher. On the other hand, an Fe content greater than 0.5% increases the fraction of an Fe-based alloy, thus lowering thermal conductivity.

Mn: 0.02% or less (exclusive of 0%): Manganese (Mn) improves the strength of the aluminum alloy by forming a microphase in the matrix. Since an excessive amount of manganese decreases the effects afforded by other elements, its maximum amount is preferably limited to 0.02%.

Mg: 0.1~0.3%: Magnesium (Mg) forms a reinforcing phase of $Mg_2Si$ to increase the strength of the aluminum alloy. To accomplish this reinforcing effect, Mg needs to be added in an amount of 0.1% or higher. However, an amount exceeding 0.3% increases the formation of precipitates, resulting in decreased thermal conductivity of the aluminum alloy at high temperatures.

Zr: 0.1% or less (exclusive of 0%): Zirconium (Zr) is an element with high coherence with Al. At a content of up to 0.1%, Zr is expected to improve the thermal conductivity of the aluminum alloy. On the other hand, when Zr is added in an amount greater than 0.1%, the formation of $Al_3Zr$ increases, which decreases the elongation rate of the aluminum alloy.

Cr: 0.1~0.2%: Chromium (Cr) functions to morphologically change the Fe-based precipitate AlFeSi from a needle-like form to a polygonal form, thus contributing to improving the thermal conductivity and elongation rate of the aluminum alloy. In order to control the content of the precipitate (AlFeSi) at a desired level, the weight ratio of Fe/Cr needs to fall within a range of 1.0~2.5, with the consequent regulation of Cr content within the range of 0.1~0.2%.

The remainder of the aluminum alloy is composed of aluminum (Al) and inevitable impurities.

In the present disclosure, a molten metal having the composition is manufactured into a cylinder head having excellent thermal conductivity at high temperatures and excellent strength, using a conventional method. It includes casting a molten metal of desired components, and subjecting the result to solution treatment and then to aging heat treatment.

EXAMPLES

A better understanding of the present disclosure may be obtained through the following examples which are set forth to illustrate, but are not to be construed to limit the present disclosure.

According to conditions for the commercial manufacture of cylinder heads, final products were experimentally manufactured, in which molten metals having the respective compositions listed in Table 1 were cast and subjected to solution treatment and then aging heat treatment. Aging heat treatment was conducted at 270° C. in Comparative Example 10, but at the T7 heat treatment temperature (250° C.) in the other Examples and Comparative Examples and for the commercial material.

TABLE 1

| | Si | Cu | Fe | Mn | Mg | Zr | Cr | Fe/Cr (Wt) | Al(Fe, Cr)Si (wt %) |
|---|---|---|---|---|---|---|---|---|---|
| Commercial Material (AC2B-T7) | 6.5 | 3.2 | 0.17 | 0.015 | 0.10 | — | — | — | |
| Ex. 1 | 4.5 | 3.0 | 0.22 | 0.018 | 0.27 | 0.1 | 0.11 | 1.8 | 1.05 |
| Ex. 2 | 5.0 | 4.0 | 0.48 | 0.019 | 0.28 | 0.1 | 0.19 | 2.5 | 2.27 |
| Ex. 3 | 4.5 | 3.0 | 0.20 | 0.018 | 0.27 | 0.1 | 0.20 | 1.0 | 1.26 |
| C. Ex. 1 | 6.0 | 3.5 | 0.40 | 0.02 | 0.20 | 0.1 | 0.20 | — | — |
| C. Ex. 2 | 4.0 | 3.5 | 0.40 | 0.02 | 0.20 | 0.1 | 0.20 | — | — |
| C. Ex. 3 | 4.8 | 4.5 | 0.40 | 0.02 | 0.20 | 0.1 | 0.20 | — | — |
| C. Ex. 4 | 4.8 | 2.5 | 0.40 | 0.02 | 0.20 | 0.1 | 0.20 | — | — |
| C. Ex. 5 | 4.8 | 3.5 | 0.10 | 0.02 | 0.20 | 0.1 | 0.20 | 0.5 | 0.90 |
| C. Ex. 6 | 4.8 | 3.5 | 0.60 | 0.02 | 0.20 | 0.1 | 0.20 | 3.0 | 2.60 |
| C. Ex. 7 | 4.8 | 3.5 | 0.40 | 0.02 | 0.20 | 0.2 | 0.20 | — | — |
| C. Ex. 8 | 4.8 | 3.5 | 0.40 | 0.02 | 0.20 | 0.1 | 0.05 | 8.0 | 1.50 |
| C. Ex. 9 | 4.8 | 3.5 | 0.40 | 0.02 | 0.20 | 0.1 | 0.30 | 1.3 | 2.35 |
| C. Ex. 10 | 5.0 | 4.0 | 0.50 | 0.019 | 0.29 | 0.1 | 0.20 | 2.5 | 2.38 |

The cylinder heads manufactured under the conditions were measured for thermal conductivity at 25° C. and at 200° C. and for yield strength, tensile strength, and elongation rate at 25° C. The results are summarized in Table 2, below.

TABLE 2

| | Thermal Conductivity | | Yield Strength | Tensile Strength | Elongation |
|---|---|---|---|---|---|
| | (W/mK @ 25° C.) | (W/mK @ 200° C.) | (MPa) | (MPa) | (%) |
| Commercial Material (AC2B-T7) | 160 | 165 | 218 | 300 | 2~4 |
| Ex. 1 | 183 | 197 | 194 | 305 | 2.6 |
| Ex. 2 | 173 | 187 | 203 | 300 | 2.2 |
| Ex. 3 | 181 | 196 | 196 | 296 | 2.4 |
| C. Ex. 1 | 165 | 175 | — | 309 | — |
| C. Ex. 2 | 172 | 187 | 181 | 278 | 2.7 |
| C. Ex. 3 | 168 | 178 | 192 | 310 | 1.9 |
| C. Ex. 4 | 171 | 186 | 174 | 267 | 2.9 |
| C. Ex. 5 | 175 | 181 | 185 | 284 | 2.2 |
| C. Ex. 6 | 165 | 176 | 189 | 303 | 1.3 |
| C. Ex. 7 | 167 | 176 | 189 | 294 | 1.8 |
| C. Ex. 8 | 168 | 178 | 179 | 268 | 1.5 |
| C. Ex. 9 | 169 | 180 | 185 | 277 | 1.4 |
| C. Ex. 10 | 166 | 175 | 190 | 264 | 1.2 |

As is understood from the data of Tables 1 and 2, the aluminum alloys of the Examples, which have the composition defined in the present disclosure, comprising, by weight, Si: 4.5~5.0%, Cu: 3.0~4.0%, Fe: 0.2~0.5%, Mn: 0.02% or less (exclusive of 0%), Mg: 0.1~0.3%, Zr: 0.1% or less (exclusive of 0%), Cr: 0.1~0.2%, a balance of Al and inevitable impurities to form 100%, exhibited a thermal conductivity of 185 W/mK or higher at 200° C., a yield strength of 190 MPa or higher, a tensile strength of 290 MPa or higher, and an elongation rate of 2.0 or higher.

In addition, Al(Fe,Cr)Si was formed as a reinforcing phase at fractions of 1.05 wt %, 2.27 wt %, and 1.26 wt % in Examples 1 to 3, respectively, thus guaranteeing desired levels of tensile strength and thermal conductivity. Accordingly, the content of the Al(Fe,Cr)Si phase is preferably controlled in a range of 1.0~2.3 wt %. As used herein, the term "the content of the Al(Fe,Cr)Si phase" means the content of the Al—Fe—Si-based phase plus the Al—Cr—Si-based content.

On the other hand, the aluminum alloys of Comparative Examples 2 and 4, in which the contents of both Si and Cu exceeded the respective upper limitations, were observed to maintain thermal conductivity of 185 W/mK or higher at 200° C., but to have poor tensile strength because of the absence of the Al(Fe,Cr)Si phase.

The aluminum alloy of Comparative Example 6, in which Fe was added in an amount exceeding the upper limitation defined according to the present disclosure, exhibited a desired level of tensile strength due to the abundance of the Al(Fe,Cr)Si phase, but poor thermal conductivity at 200° C.

As for Comparative Example 10, its aluminum alloy met the criteria for the composition defined according to the present disclosure, but underwent aging heat treatment at a relatively high temperature. More abundant in Al(Fe,Cr)Si phase than the upper limitation, the aluminum alloy exhibited low tensile strength and thermal conductivity at 200° C. In particular, the elongation rate of the aluminum alloy was significantly decreased.

Figure 2:
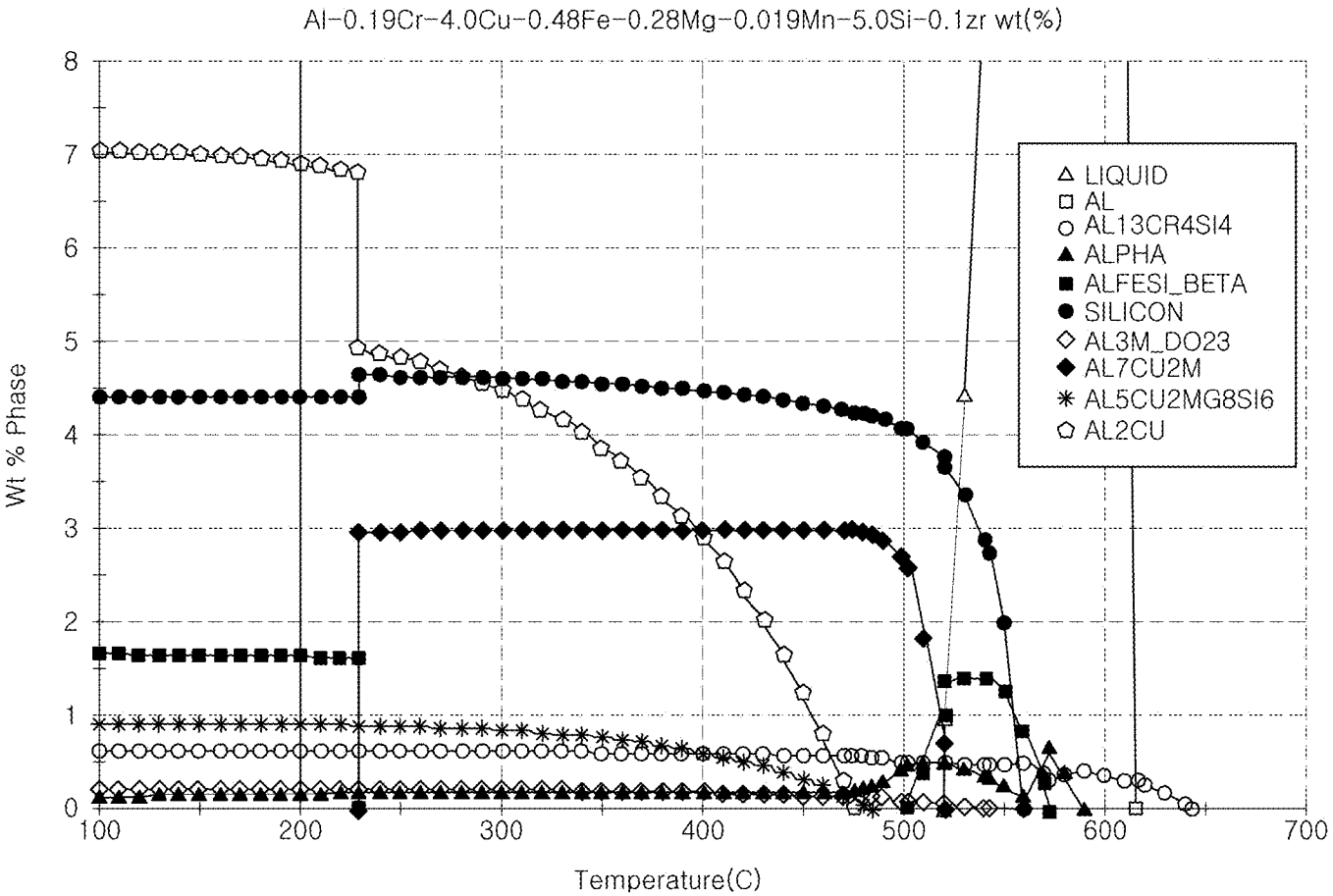
Figure 3:
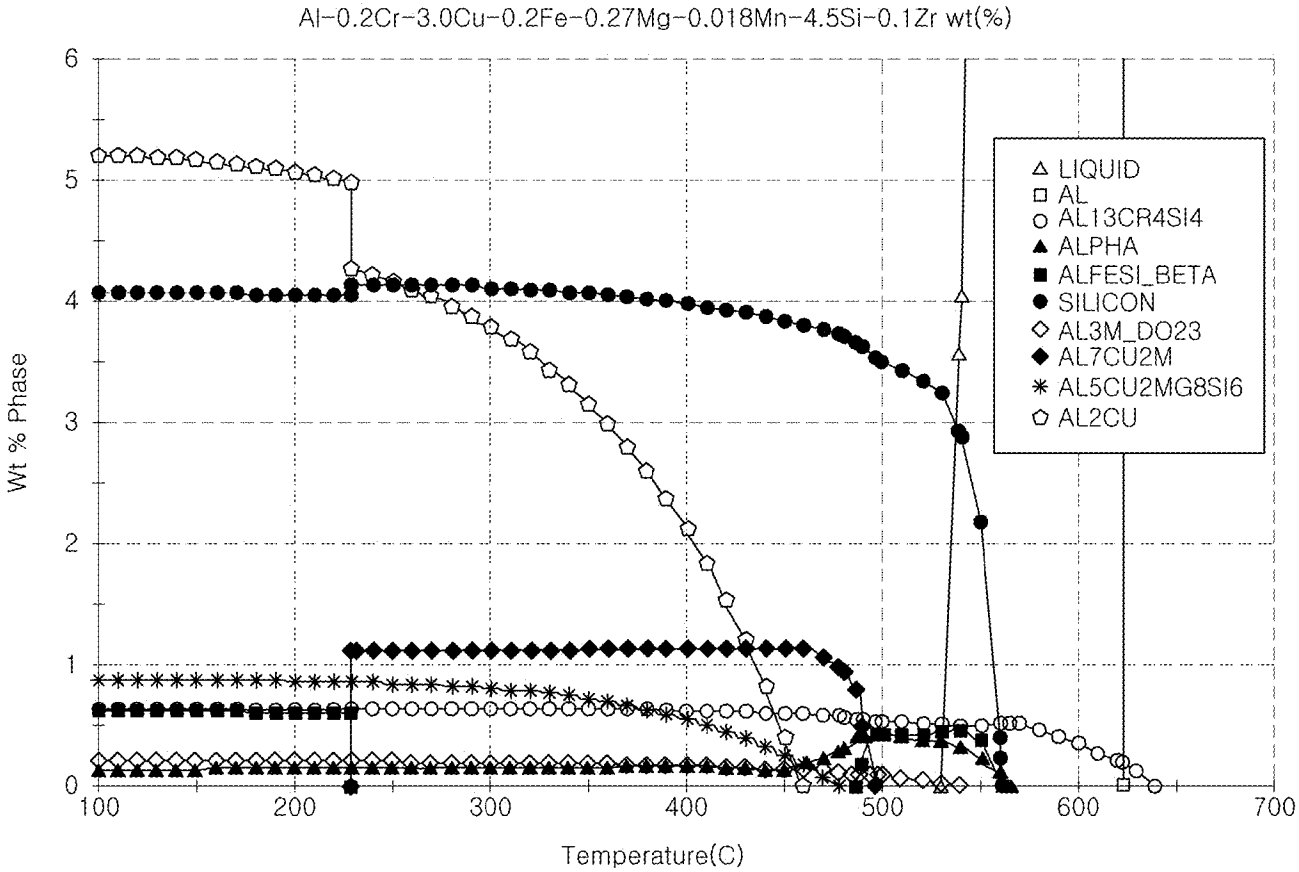
Figure 4:
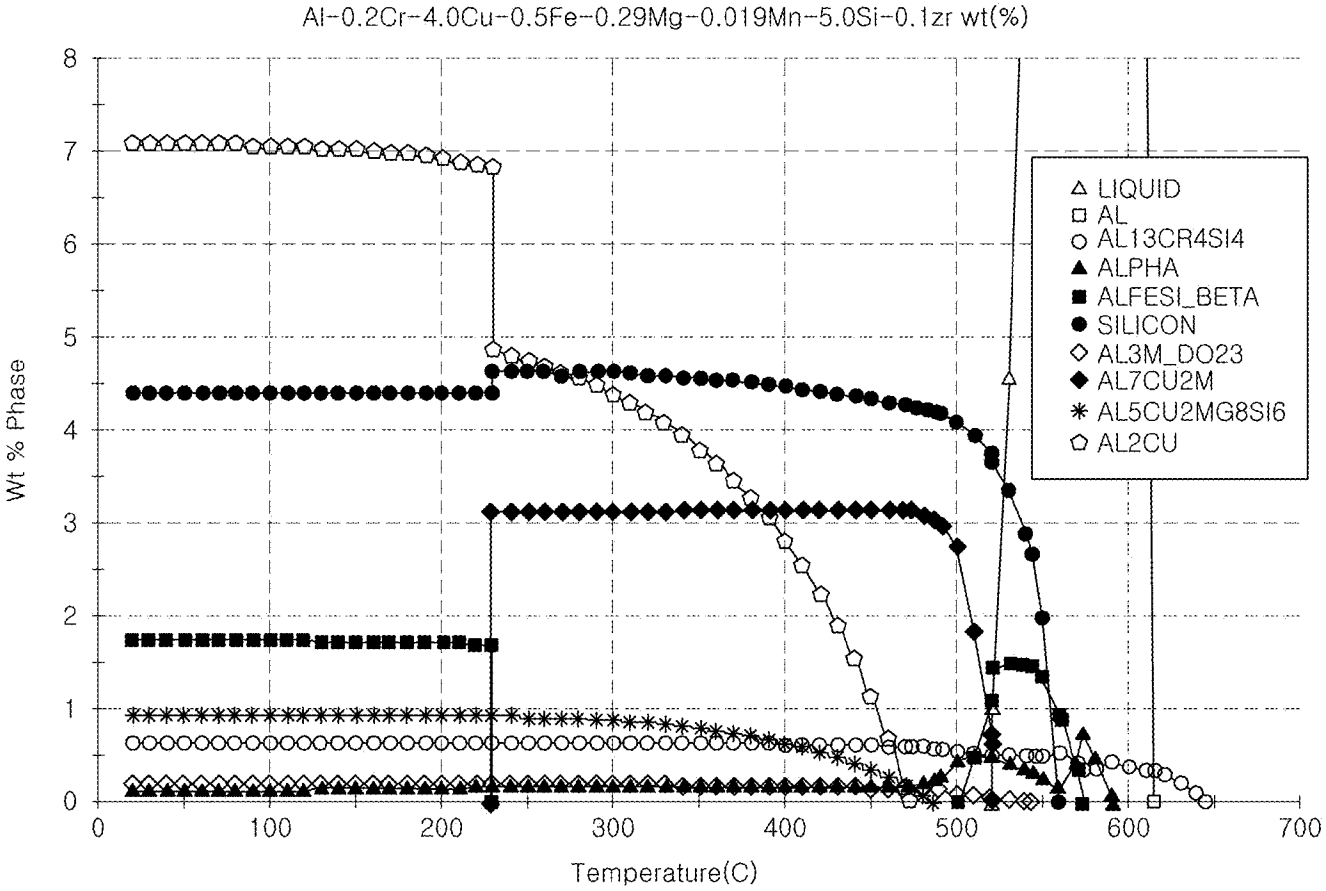
FIG. 4 depicts qualitative and quantitative analysis results of reinforcing phases formed by temperature in an aluminum alloy of Comparative Example 10.

FIGS. 1 to 3 depict qualitative and quantitative analysis results of reinforcing phases formed by temperature in the aluminum alloys of the present disclosure, and FIG. 4 depicts qualitative and quantitative analysis results of reinforcing phases formed by temperature in the aluminum alloy of Comparative Example 10.

In the legends of FIGS. 1 to 4, AL13CR4SI4 and ALFESI_BETA mean an Al—Cr—Si-based reinforcing phase and an Al—Fe—Si-based reinforcing phase, respectively.

FIG. 1 shows qualitative and quantitative analysis results of reinforcing phases formed by temperature in the aluminum alloy of Example 1, in which an Al(Fe,Cr)Si phase is present at a content of 1.05% (0.35% [AlCrSi]+0.7% [AlFeSi]=1.05%).

FIG. 2 shows qualitative and quantitative analysis results of reinforcing phases formed by temperature in the aluminum alloy of Example 2, in which an Al(Fe,Cr)Si phase is present at a content of 2.27% (0.61% [AlCrSi]+1.66% [AlFeSi]=2.27%).

FIG. 3 shows qualitative and quantitative analysis results of reinforcing phases formed by temperature in the aluminum alloy of Example 3, in which an Al(Fe,Cr)Si phase is present at a content of 1.26% (0.64% [AlCrSi]+0.62% [AlFeSi]=1.26%).

FIG. 4 shows qualitative and quantitative analysis results of reinforcing phases formed by temperature in the aluminum alloy of Comparative Example 10, in which an Al(Fe,Cr)Si phase is present at a content of 2.38% (0.64% [AlCrSi]+1.74% [AlFeSi]=2.38%).

From the results of FIGS. 1 to 4, it is understood that even though both the composition of elements and the Fe/Cr ratio meet the conditions defined in the present disclosure, a content of Al(Fe,Cr)Si phase exceeding 2.3% causes a sharp decrease in thermal conductivity (to 175 W/mK), and thus does not make a contribution to the thermal efficiency of the cylinder head, as shown in Comparative Example 10. Further, being reduced in elongation rate (to 1.2%), the aluminum alloy of Comparative Example 10 was observed to be difficult to apply to a cylinder head, which requires durability.

Figure 5:
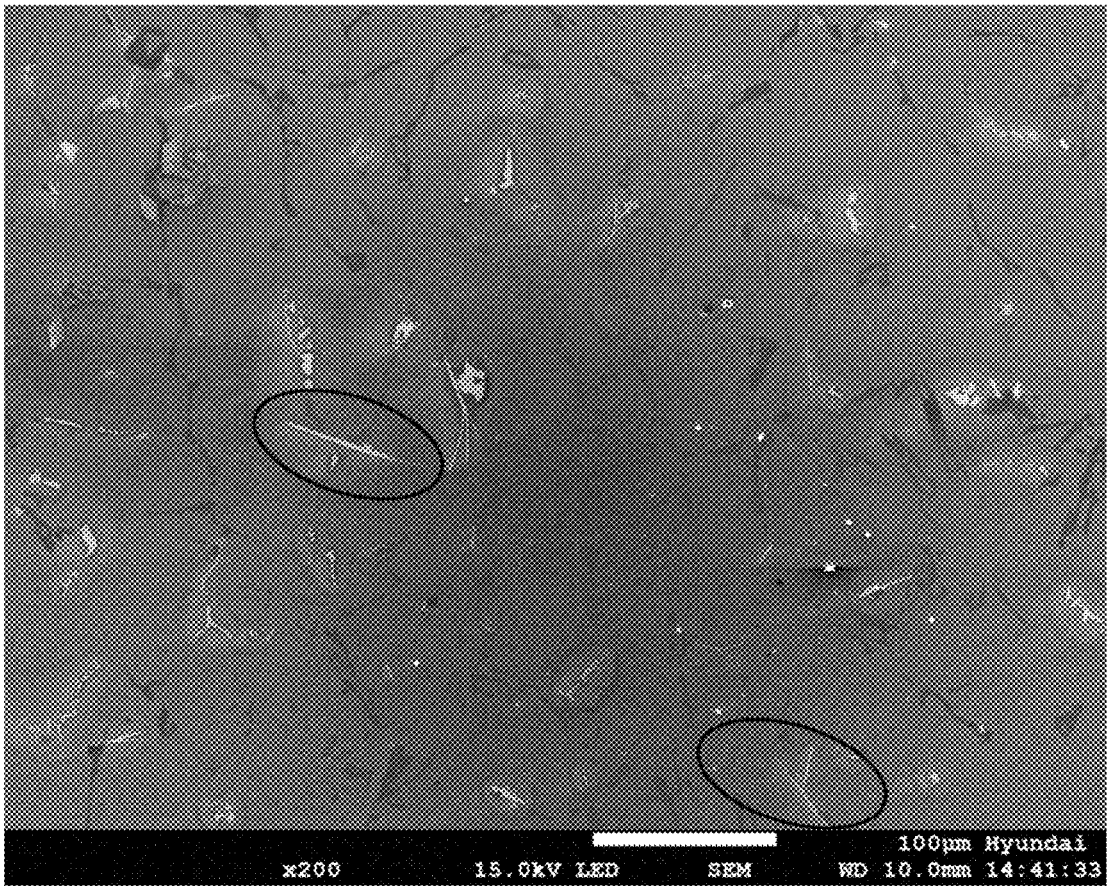
FIG. 5 is an SEM showing a reinforcing phase formed in a conventional commercial material.
Figure 6:
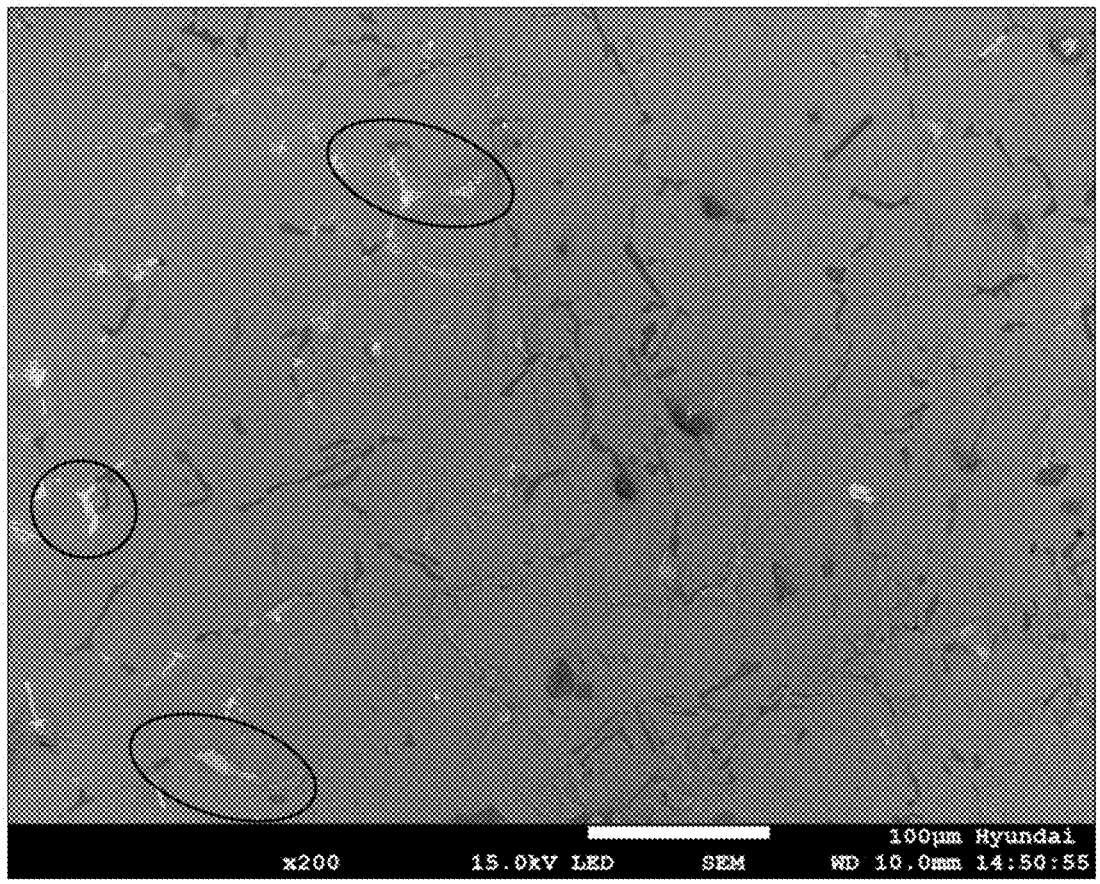
FIG. 6 is an SEM showing a reinforcing phase formed in an aluminum alloy according to an embodiment of the present disclosure.

FIG. 5 is a SEM showing a reinforcing phase formed in a conventional commercial material, and FIG. 6 is a SEM showing a reinforcing phase formed in an aluminum alloy according to an embodiment of the present disclosure.

As can be seen in FIG. 5, the SEM showing the microstructure of the commercial aluminum alloy of Table 1 indicates the formation of needle-like Al—Fe—Si-based precipitates.

On the other hand, the SEM of FIG. 6, showing the microstructure of the aluminum alloy according to Example 3 of Table 1, indicates that Al—Fe—Si-based precipitates take polygonal forms, but not needle-like forms.

The aluminum alloy for use in cylinder heads in accordance with the present disclosure enjoys the following advantages:

First, it can maintain high thermal conductivity at the high temperatures occurring during the operation of the cylinder to thus prevent a knocking phenomenon.

In addition, having strength as large as or larger than that of conventional alloy, the aluminum alloy of the present disclosure can be applied to cylinder heads.

Although the present invention was described with reference to specific embodiments shown in the drawings, it is apparent to those skilled in the art that the present invention may be changed and modified in various ways without departing from the scope of the present invention, which is described in the following claims.

What is claimed is:

1. An aluminum alloy comprising, by weight, Si: 4.5~50.0%, Cu: 3.0~4.0%, Fe: 0.2~0.5%, Mn: 0.02% or less (exclusive of 0%), Mg: 0.1~0.3%, Zr: 0.1% or less (exclusive of 0%), Cr: 0.1~0.2%, and a balance of Al and inevitable impurities to form 100%, with a reinforcing phase of Al(Fe,Cr)Si ranging from 1.0 to 2.3%, wherein aluminum alloy has a weight ratio of Fe/Cr ranging from 1.0 to 2.5.

2. The aluminum alloy of claim 1, having a thermal conductivity of 185 W/mK or higher at 200° C.

3. The aluminum alloy of claim 1, having a tensile strength of 290 MPa or higher at 2° C.

4. The aluminum alloy of claim 1, wherein the reinforcing phase of Al(Fe,Cr)Si is polygonal.

5. The aluminum alloy of claim 4, having a thermal conductivity of 185 W/mK or higher at 200° C.

6. The aluminum alloy of claim 4, having a tensile strength of 290 MPa or higher at 2° C.

7. The aluminum alloy of claim 1, wherein the aluminum alloy has a thermal conductivity of 185 W/mK or higher at 200° C. and a tensile strength of 290 MPa or higher at 2° C.

8. The aluminum alloy of claim 7, wherein the reinforcing phase of Al(Fe,Cr)Si is polygonal.

9. A cylinder head for an automotive engine, the cylinder head comprising an aluminum alloy that comprises, by weight, Si: 4.5~50.0%, Cu: 3.0~4.0%, Fe: 0.2~0.5%, Mn: 0.02% or less (exclusive of 0%), Mg: 0.1~0.3%, Zr: 0.1% or less (exclusive of 0%), Cr: 0.1~0.2%, and a balance of Al and inevitable impurities to form 100%, with a reinforcing phase of Al(Fe,Cr)Si ranging from 1.0 to 2.3%, wherein aluminum alloy has a weight ratio of Fe/Cr ranging from 1.0 to 2.5.

10. The cylinder head of claim 9, having a thermal conductivity of 185 W/mK or higher at 200° C.

11. The cylinder head of claim 9, having a tensile strength of 290 MPa or higher at 25° C.

12. The cylinder head of claim 9, wherein the reinforcing phase of Al(Fe,Cr)Si is polygonal.

* * * * *